US011097887B2

(12) United States Patent
Mogil et al.

(10) Patent No.: US 11,097,887 B2
(45) Date of Patent: Aug. 24, 2021

(54) INSULATED CONTAINER WITH FOLDING CLOSURE

(71) Applicant: CALIFORNIA INNOVATIONS INC., Toronto (CA)

(72) Inventors: Melvin Mogil, North York (CA); Evan Roderick Olander, Chicago, IL (US); Marlowe Gustavo Baca, Berwyn, IL (US)

(73) Assignee: CALIFORNIA INNOVATIONS INC.

( * ) Notice: Subject to any disclaimer, the term of this patent is extended or adjusted under 35 U.S.C. 154(b) by 0 days.

(21) Appl. No.: 16/435,768

(22) Filed: Jun. 10, 2019

(65) Prior Publication Data

US 2019/0382185 A1 Dec. 19, 2019

Related U.S. Application Data

(60) Provisional application No. 62/684,398, filed on Jun. 13, 2018.

(51) Int. Cl.

| | |
|---|---|
| ***B65D 81/38*** | (2006.01) |
| ***B65D 43/16*** | (2006.01) |
| *A45C 11/20* | (2006.01) |

(52) U.S. Cl.

CPC ..... *B65D 81/3813* (2013.01); *B65D 43/16* (2013.01); *A45C 11/20* (2013.01); *B65D 2313/00* (2013.01)

(58) Field of Classification Search

CPC ..... B65D 43/16; B65D 81/3813

See application file for complete search history.

(56) References Cited

U.S. PATENT DOCUMENTS

| | | | | | |
|---|---|---|---|---|---|
| D241,783 | S * | 10/1976 | Sykes | D3/268 | |
| 4,561,525 | A * | 12/1985 | Shidner | A45C 3/00 | 190/106 |
| 5,873,504 | A * | 2/1999 | Farmer | A45C 3/00 | 150/113 |
| 6,213,268 | B1 * | 4/2001 | Dancyger | A45C 13/02 | 150/113 |
| D646,058 | S * | 10/2011 | Brusa | D3/287 | |
| 8,936,172 | B2 * | 1/2015 | Hicks | A01M 31/006 | 220/592.2 |
| 2002/0064318 | A1 * | 5/2002 | Malone | B65D 81/3853 | 383/3 |
| 2006/0239593 | A1 * | 10/2006 | Fidrych | A45C 13/02 | 383/40 |

* cited by examiner

*Primary Examiner* — Derek J Battisti
(74) *Attorney, Agent, or Firm* — Ostrolenk Faber LLP

(57) ABSTRACT

A container assembly has an insulated wall structure and a chamber. The chamber has an opening governed by a closure member that is movable between open and closed positions. The closure may include a hood. The container assembly has a first periphery. The cap has a second periphery defining the opening. A skirt extends between the peripheries. The second periphery is longer than the body of the container assembly. The skirt is foldable. In the closed position the first and second margins being of the second periphery are secured to each other, and the skirt is at least partially folded. In the open position, the skirt is more unfolded than in said closed position, and at least a portion of one of the margins is located more distantly from the chamber, or the wall structure than when closed. The closure has a floating jaw-bone reinforcement arrangement.

9 Claims, 18 Drawing Sheets

INSULATED CONTAINER WITH FOLDING CLOSURE

This application claims the benefit of priority of U.S. Provisional Patent Application Ser. No. 62/684,398 filed Jun. 13, 2018, the specification and drawing thereof being incorporated in their entirety herein by reference.

FIELD OF THE INVENTION

This invention relates to the field of portable insulated containers.

BACKGROUND OF THE INVENTION

Soft-sided insulated containers have become popular for carrying either articles that may best be served cool, such as beverages or salads, or warm, such as appetizers, and so on. Often such containers are used for carrying children's lunches, as at school or when camping. One type of insulated container is waterproof. Such containers may be welded together, as when panels are RF welded. However, the use of a waterproof zipper and the associated waterproof webbing or flanges makes the assembly stiff. Further, the welded waterproof wall structure tends to be quite stiff. The overall structure is sufficiently stiff that it can be awkward to try to put objects into the container. It may require not inconsiderable effort to deflect the body of the bag, and to hold it open, while trying to move objects into or out of the container.

SUMMARY OF THE INVENTION

In an aspect of the invention there is a container assembly. It has an insulated wall structure defining therewithin a chamber in which to receive objects. The chamber has an opening. The container assembly includes a closure mounted to the wall structure. The closure is movable between an open position and a closed position to govern access to the chamber. The closure includes a cap. The cap has a first periphery mated to the wall structure, a second periphery defining an opening through the cap, and a skirt extending between the first periphery and the second periphery. The second periphery has a first margin and a second margin. The skirt is foldable. In the closed position of the closure, the first and second margins are matingly secured to each other, and the skirt is at least partially folded. In the open position, the skirt is more unfolded than in the closed position, and at least a portion of one of the margins is located more distant from the wall structure than in the closed position.

In a feature of that aspect of the invention, a first portion of a tracked fastener is mounted to the first margin of the second periphery, and a second tracked fastener portion is mounted to the second margin of the second periphery, the first and second portions of the tracked fastener is mutually engaged when the closure is in the closed position. In another feature, the tracked fastener is a waterproof zipper. In a further feature, at least one of the first margin and the second margin defines a U-shaped jaw. In an additional feature, both the first margin and the second margin define a respective U-shaped jaw, and the respective U-shaped jaws are symmetrically operable and opposed. In another feature, the wall structure, in plan view, is rectangular, has a length and a width, the second periphery is opened and closed with a tracked fastener, and the tracked fastener has a length that exceeds the length of the rectangular wall structure. In another feature, the body of the container is RF welded.

In still another feature, the second periphery has a first margin and a second margin. A tracked fastener has corresponding first and second portions mounted to aid first and second margins respectively. At least the first margin has a first stiffener mounted thereto. The first stiffener running lengthwise along the first margin. In a further feature, the stiffener defines a jaw bone. In another feature, the first j aw bone is attached to a floating hinge. In still another feature, the container assembly has a main body has a length and a width and a depth. The length is greater than the width. The tracked fastener is mounted to run predominantly lengthwise relative to the container assembly. The tracked fastener is longer than the length of the main body.

In another aspect, there is an insulated container has an insulated wall structure defining a chamber therewithin. The wall structure including a closure operable to govern access to the chamber. The closure includes a first U-shaped jaw.

In a feature of that aspect, the U-shaped jaw includes a corresponding U-shaped stiffener. In another feature, the container has the first U-shaped jaw and a second U-shaped jaw. The first and second jaws are co-operable. In another feature, the first and second jaws are movable from a first position in which the first and second jaws are side-by-side, and a second position in which the first and second jaws are angularly displaced away from each other. In a further feature there is a tracked fastener mounted to the closure between the first and second j aws. The tracked fastener is movable between a first, closed position in which the jaws are constrained from moving apart from each other, and a second, open, position in which the jaws are movable relative to each other. In a further feature, the tracked fastener is waterproof.

In another aspect of the invention, there is an insulated container assembly having a chamber defined therewithin. The insulated container assembly has a soft-sided insulated body and a movable closure. The closure includes a floating jaw-bone.

In a feature of that aspect, the insulated body has a height, a width, and a length, said closure forms a top wall that co-operates with said insulated body, said movable closure having a first position and a second position; in said first position said insulated container assembly having a six-sided box shape; and in said second position said jaw-bone being rotated upwardly and outwardly to form an open mouth of said chamber. In another feature, the insulated container assembly has a pair of said jaw-bones said pair of jaw-bones being mutually opposed. In still another feature, a tracked fastener runs lengthwise between said mutually opposed jaws. In a further feature, the closure is at least partially folded when closed, and being less folded when open. In still another feature, the insulated container assembly is waterproof.

The features of the aspects of the invention may be mixed and matched as appropriate without need for multiplication and repetition of all possible permutations and combinations.

BRIEF DESCRIPTION OF THE DRAWINGS

These and other aspects and features of the invention may be more readily understood with the aid of the illustrative Figures below, showing an example, or examples, embodying the various aspects and features of the invention, provided by way of illustration, and in which.

DETAILED DESCRIPTION

Figure 1A:
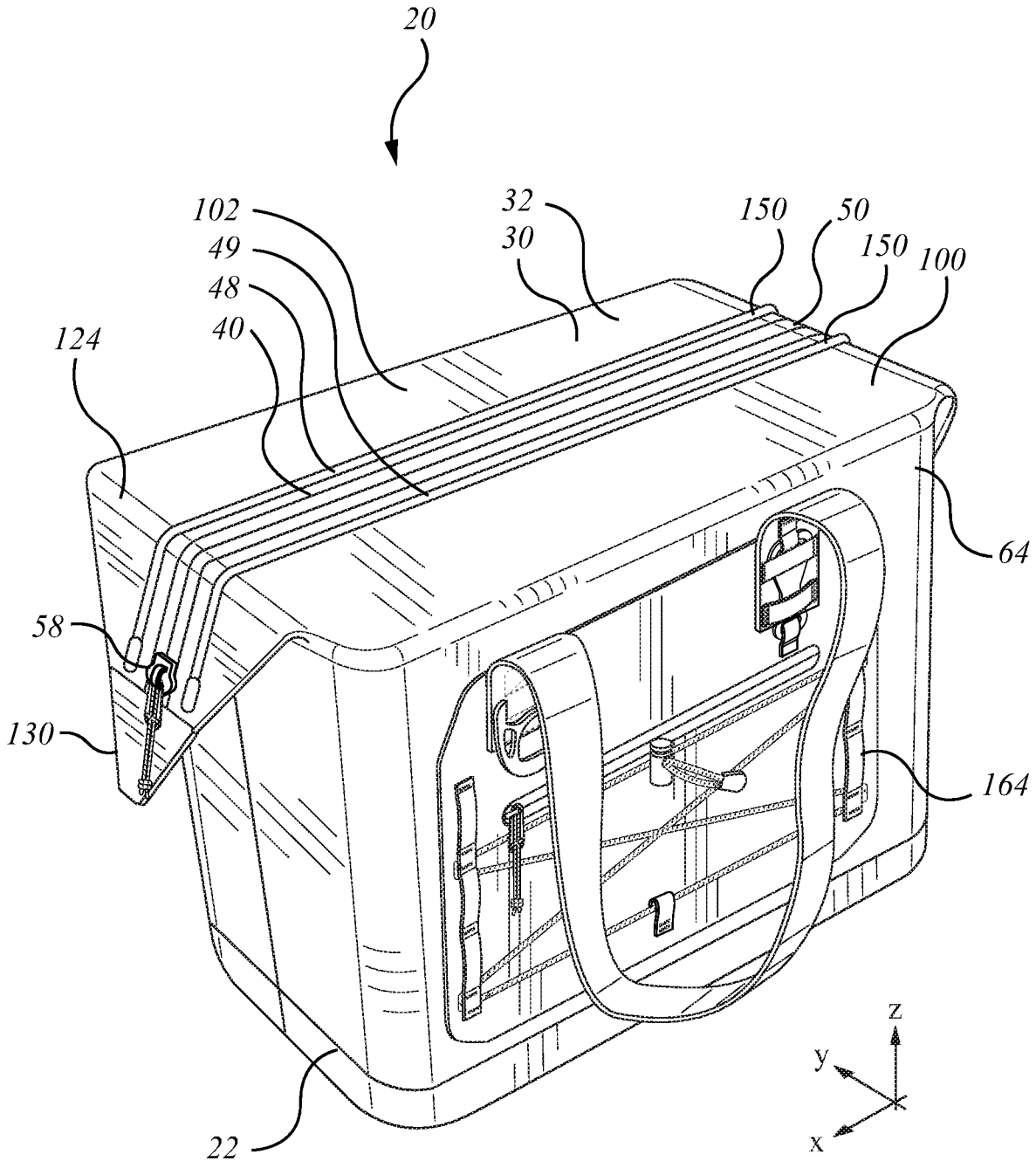
FIG. 1*a* shows a perspective view from in front, to one side and above of an embodiment of an insulated container assembly in a closed position or condition.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are substantially to scale, except where noted otherwise, such as in those instances in which proportions may have been exaggerated in order more clearly to depict certain features.

For the purposes of this description, it may be that a Cartesian frame of reference may be employed. In such a frame of reference, the long, or largest, dimension of an object may be considered to extend in the direction of the x-axis, the base of the article, where substantially planar, may be considered to extend in an x-y plane, and the height of the article may be measured in the vertical, or z-direction. In other contexts, the z-direction may be the through thickness of a substantially planar panel where the major dimensions lie in the x- and y-directions. The largest container panels herein may be designated arbitrarily as either the front and rear sides or top and bottom sides, faces, or portions of the container. Similarly, the closure member, or opening is arbitrarily designated as being at the top, and the base panel is designated as being at the bottom, as these terms may be appropriate for the customary orientation in which the objects may usually be found, sold, or employed, notwithstanding that the objects may be picked up and placed on one side or another from time to time at the user's choice. It should also be understood that, within the normal range of temperatures to which human food and human touch is accustomed, although the term cooler, or cooler container, or cooler bag, may be used, such insulated structures may generally also be used to aid in keeping food, beverages, or other objects either warm or hot as well as cool, cold, or frozen.

In this specification reference is made to insulated containers. The adjective "insulated" is intended to be given its usual and normal meaning as understood by persons skilled in the art. It is not intended to encompass single layers, or skins, of conventional webbing materials, such as Nylon™, woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Definitions provided herein are intended to supplant any dictionary definition, and to prevent interpretation that strays from the customary and ordinary meaning of the term "insulated". The Applicant also explicitly excludes cellophane, waxed paper, tin foil, paper, or other single use disposable (i.e., not intended to be re-used) materials from the definition of "washable".

Similarly, this description may tend to distinguish various embodiments of hard shell containers from soft-sided containers. In the jargon of the trade, a soft-sided cooler, or bag, or container, is one that does not have a substantially rigid, high density exoskeleton. A typical example of a container having a hard exoskeleton is one having a molded shell, e.g., of ABS or polyethylene, or other common types of molded plastic. Rather, a soft-sided container may tend not to be substantially rigid, but may rather have a skin that is flexible, or crushable, or sometimes foldable. By way of an example, which is not intended to be exhaustive, comprehensive, exclusive or limiting, a soft-sided cooler may have an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam. In some examples, a soft-sided container may still be a soft-sided container where, as described herein, it may include a substantially rigid liner, or may include one or more battens (which may be of a relatively hard plastic) concealed within the soft sided wall structure more generally, or where hard molded fittings may be used either at a container rim or lip, or to provided a base or a mounting point for wheels, but where the outside of the assembly is predominantly of soft-sided panels. Once again, this commentary is intended to forestall the adoption by the US Patent Office, (or any other Patent Office), of an interpretation of the term "soft-sided" that diverges from the ordinary and customary meaning of the term as understood by persons of ordinary skill in the art in the industry, and as used herein.

FIGS. 1*a*-1*i*, illustrate a container assembly, indicated generally as 20. It is a soft-sided insulated container. It has an insulated wall structure 22 having an interior chamber 24 defined therein. The chamber has an opening 26 at the top. Insulated wall structure 22 has a first portion that may be identified as the lower, or main, body portion 28. It also has a second portion that may be identified as the upper, or closure portion, or closure assembly 30 that is mounted to, or forms a part of wall structure 22, and that is joined to main body portion 28 of wall structure 22. Notwithstanding that body portion is a soft-sided container of flexible sides, body portion 28 may be of a fixed configuration, that of an open-topped five-sided box. While it may be flexible, as opposed to having hard-molded rigid sides, it may not be, or may not be intended to be, a foldable or collapsible structure, but rather one that tends to maintain its original shape. In that context main body portion 28 can be termed a stationary, fixed configuration, or constant morphology structure. The closure, or closure assembly 30, is a movable structure, or a changeable configuration structure. That is, it is movable between a first position or condition, in which it is in a closed configuration, which may be termed an on open position or condition; and a second position or condition in which it is in an open configuration, which may be termed a closed position or condition. As such, closure assembly 30 governs access to chamber 24.

The top, or end, or closure, or closure assembly 30, includes a first member or portion or component that may be referred to as an upper peripheral wall or membrane or web, or laminate, or skirt, which may be identified as a cowling or cowl, or mouth, or hood, or cap 32. When component 32 is in the closed position it forms a top wall, or hood, or cap that closes internal chamber 24. However, when component 32 is opened, it forms a duct, or passage or chute, or discharge, or a mouth of internal chamber 24 by which objects may be introduced into or retrieved from chamber 24. The hood or cap, or mouth, 32 opens and closes to control access to interior chamber 24. Cap 32 has a first margin or edge or periphery 34 that is mated to the rest of wall structure 22, as along a corresponding upper margin 36 of main body portion 28. Cap 32 has a second margin or edge or periphery 38 that is distant from the first margin or first periphery 34. Second periphery 38 defines an opening 40 through cap 32 more generally. When cap 32 is in place, opening 40 can be opened or closed to govern access to chamber 24. The expanse of cap 32 can be termed as being a skirt 42 that extends between first and second peripheries 34 and 38. Expressed differently, skirt 42 extends peripherally about, and away from second periphery 38, and therefore peripherally about, or around, opening 40.

Periphery 38, and therefore opening 40, may have a first portion, or side or length, or segment 44, and a second portion or side, or length, or segment 46. Segments 44 and 46 may define opposite margins of periphery 38 that mate with each other when opening 40 is closed, and that spread away from each other when opening 40 is open. The mating halves or sides 48, 49 of a tracked fastener 50 may be mounted to margins or segments 42 and 44 respectively.

Tracked fastener 50 may be a zipper, and, in the context of a waterproof insulated container such as container 20, may be a waterproof zipper. In other circumstances, the tracked fastener may be formed of interlocking plastic ribs of ridges, in the manner of a sealable plastic sandwich bag, or may be closed using mating edges that form an interlocking friction fit, or may be secured with hook and eye fabric fastener strips, such as those sold under the brand name "Velcro"™.

Figure 1B:
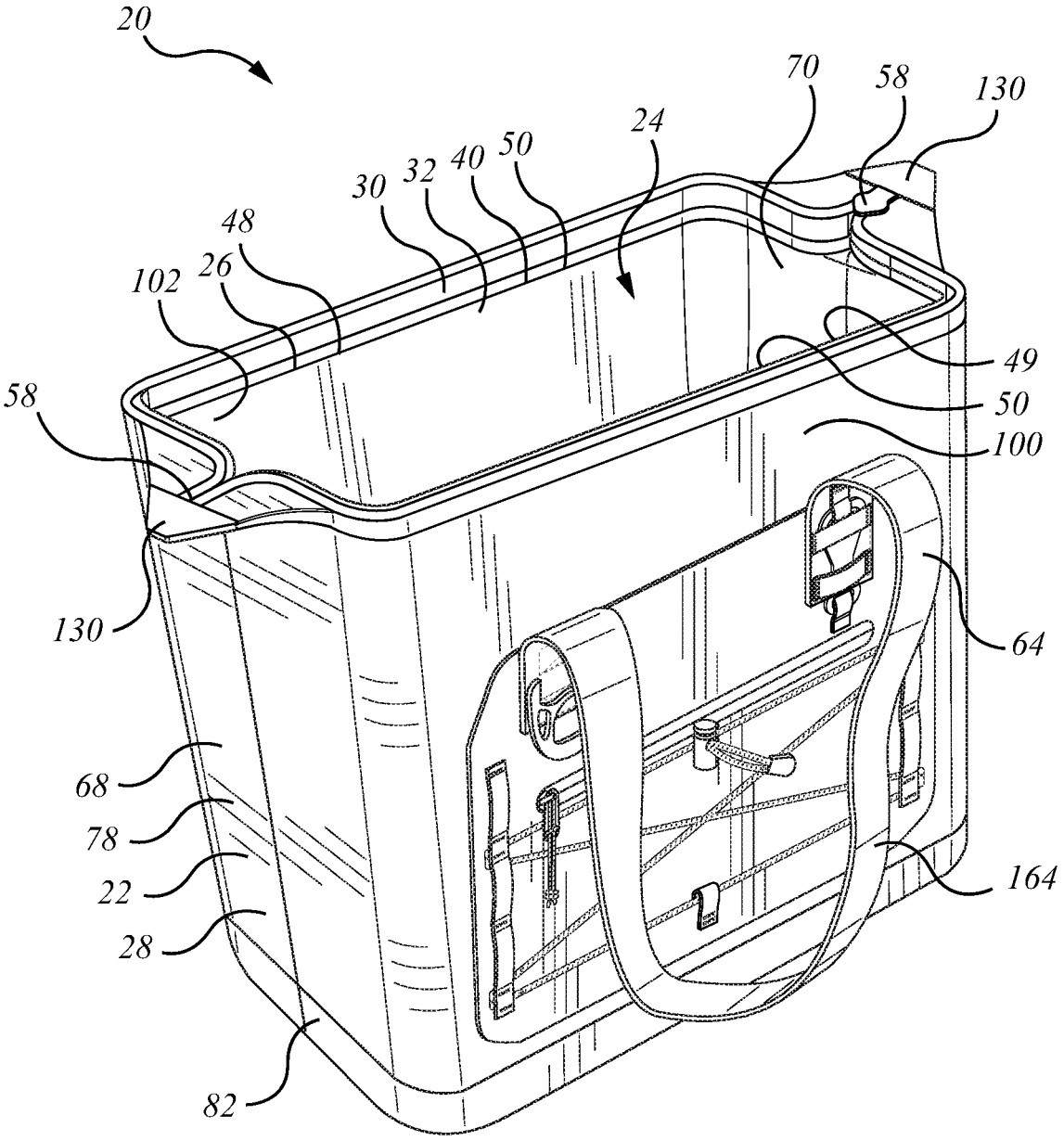
FIG. 1*b* shows the insulated container assembly of FIG. 1*a* in an open position or condition.

Skirt 42 is foldable, or, expressed differently, has folding portions. In the open position of opening 40, skirt 42 is unfolded, or predominantly unfolded. In the embodiment of FIGS. 1*a* and 1*b*, when unfolded, skirt 42 runs may have generally the same shape as main body 28 of wall structure 22. That is, where main body 26 is rectangular in plan view as seen from above, when skirt 42 is unfolded, it generally follows that rectangular plan form shape, such that the effective opening may tend to correspond approximately with the size of chamber 24. In the open position, skirt 42 is unfolded, or, expressed differently, is more unfolded, than it is when it is in the closed position. In the closed position, the first and second margins or segments 44, 46 are matingly secured to each other, and skirt 42 is at least partially folded, or, expressed differently, is more folded, or is folded differently, than when in it is in the open position. When skirt 42 is in the open position, at least a portion of one of margins or segments 44, 46 is located more distantly from the main body 26 of wall structure 22 than it is in the closed position.

The zipper, such as may be represented by tracked fastener 50, follows a path. A zipper path, or tracked fastener path more generally, is often a straight line when closed, and the margins of the web to which the tracked fastener is mounted may tend to follow straight lines. A zipper may run around a corner where the sides or flanks of the zipper extend in the direction of the membrane to which they are attached, and that membrane or web, or cloth follows a curve, e.g., around a corner. Expressed differently, the zipper passes around a corner having an axis of rotation. The side webs of the zipper may extend transversely in a surface that extends parallel to the radius of curvature. When the material is laid flat in a developed configuration, the tracked fastener path tends to be a straight line. It is less common for the zipper path to diverge, e.g., sinuously, in the plane of the web or membrane, to which the sides of the tracked fastener are attached, i.e., transversely in the web, as opposed to out-of-plane bending of the web.

In the embodiment shown, it can be seen that the ends of margins 42 and 44 are bent in both the open position and in the closed position. Looking at the margins, each of margins 44 and 46 has a middle portion, 52, a first end portion 54 and a second end portion 56. The end portions are bent or kinked to form a U-shape, like a jaw, or jaw bone. When opening 40 is closed, the U-shaped margins lie parallel to each other, and may be thought of as lying in parallel vertical planes. When the tracked fastener is opened, the middle portion 52 is lifted upward while it rotates outwardly away from the opposite margin. The ends of the U-shaped margins are held together by the end fittings 58 of the tracked fastener. Thus, as the bag is opened, the jaws tend to rotate, or have an angular displacement, such that the margin no longer lies in a vertical plane, but in an upwardly and outwardly inclined plane that rotates toward the horizontal as the mouth of the bag is opened. If the bag is fully opened, the opposite margins may tend to lie in, or close to, a common horizontal plane. In that open condition, the open end of the U of the respective U-shapes of the jaws face toward each other, such that the resultant opening may tend to be generally rectangular (if the corner of the U is roughly square) or hexagonal (if the corner of the U is less than square). In the example of FIGS. 1*a* and 1*b*, and 2*a* to 2*e*, the U-shaped jaws may be symmetrical, and their operation may be symmetrical, or substantially symmetrical, and opposed—i.e., they rotate in opposite angular directions away from each other when opening, toward each other when closing.

Looking at the structure of main body 26 of container assembly 20, there is a bottom wall 60, and an upstanding peripheral sidewall 62. To the extent that bottom wall 60 is rectangular, or generally rectangular, peripheral sidewall 62 has a pair of long side walls, or side wall portions, 64, 66; and a pair of short side walls or side wall portions 68, 70. The lower edges or margins of these wall portions mate with the peripheral margin of bottom wall 60. The upper edges or upper margins of these wall portions define an upper periphery 72, to which the closure assembly is mounted.

Figure 1C:
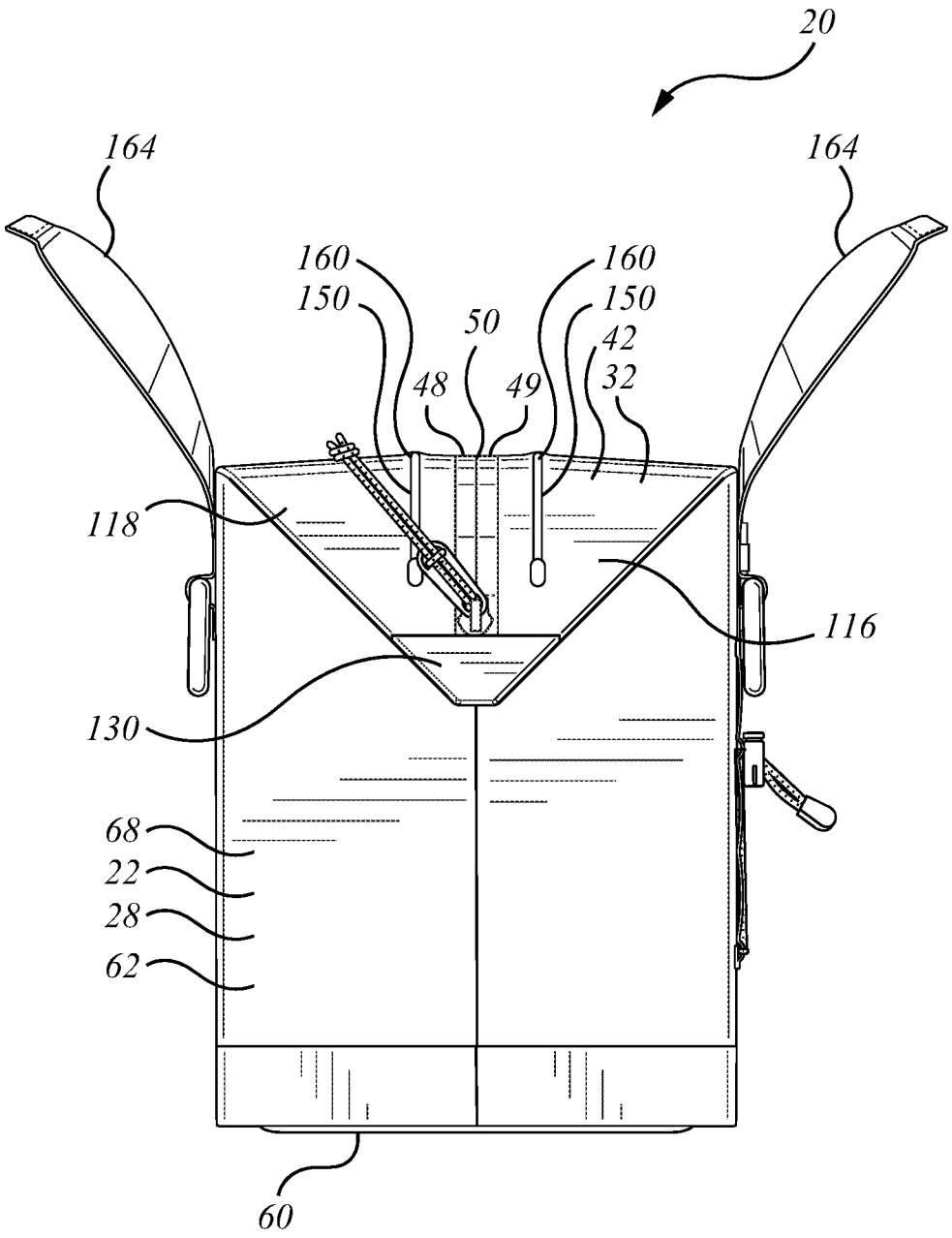
FIG. 1*c* is a left-hand side or end view of the closed container assembly of FIG. 1*a;*
Figure 1D:
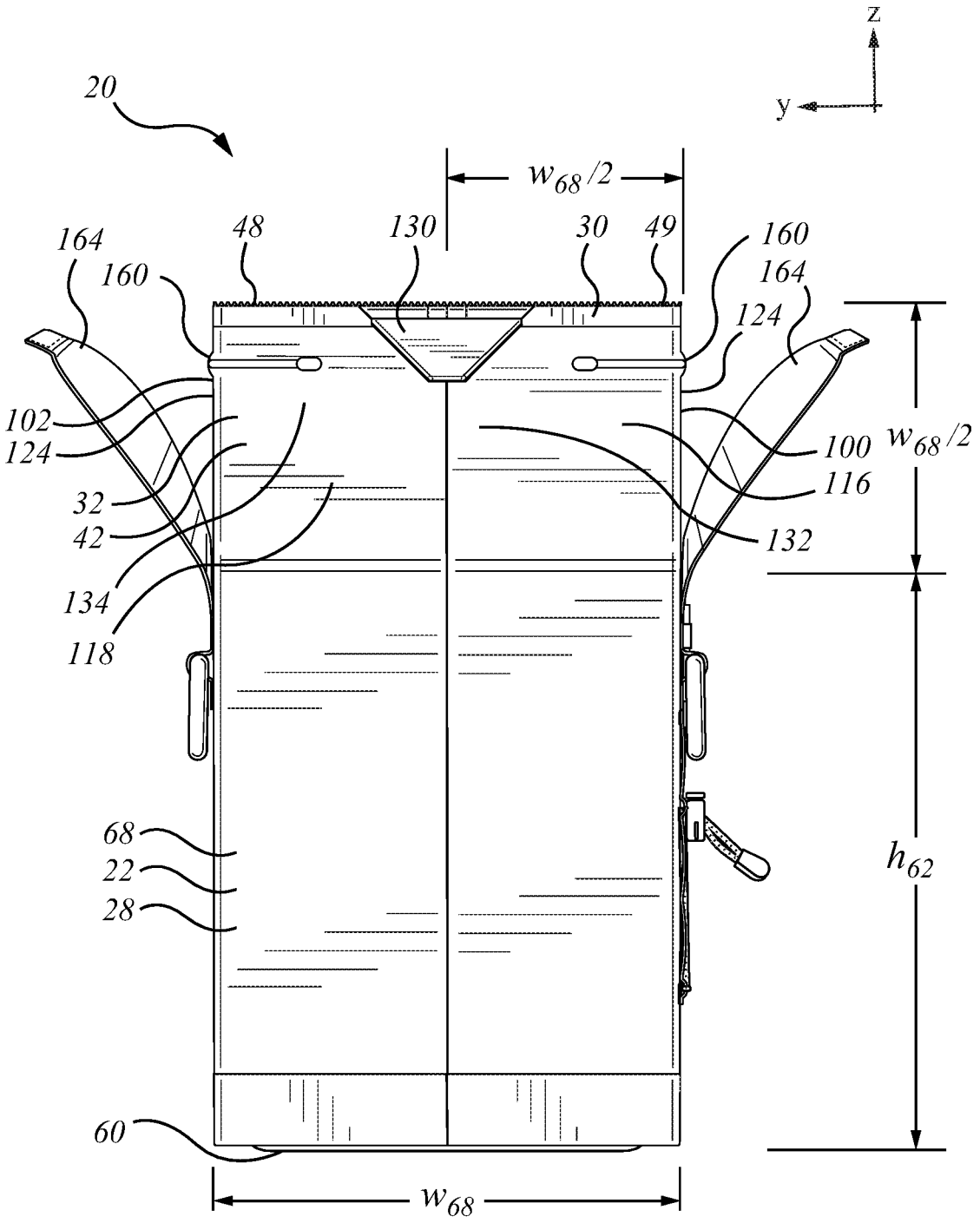
FIG. 1*d* is a left-hand side or end view of the open container assembly of FIG. 1*b;*
Figure 1E:
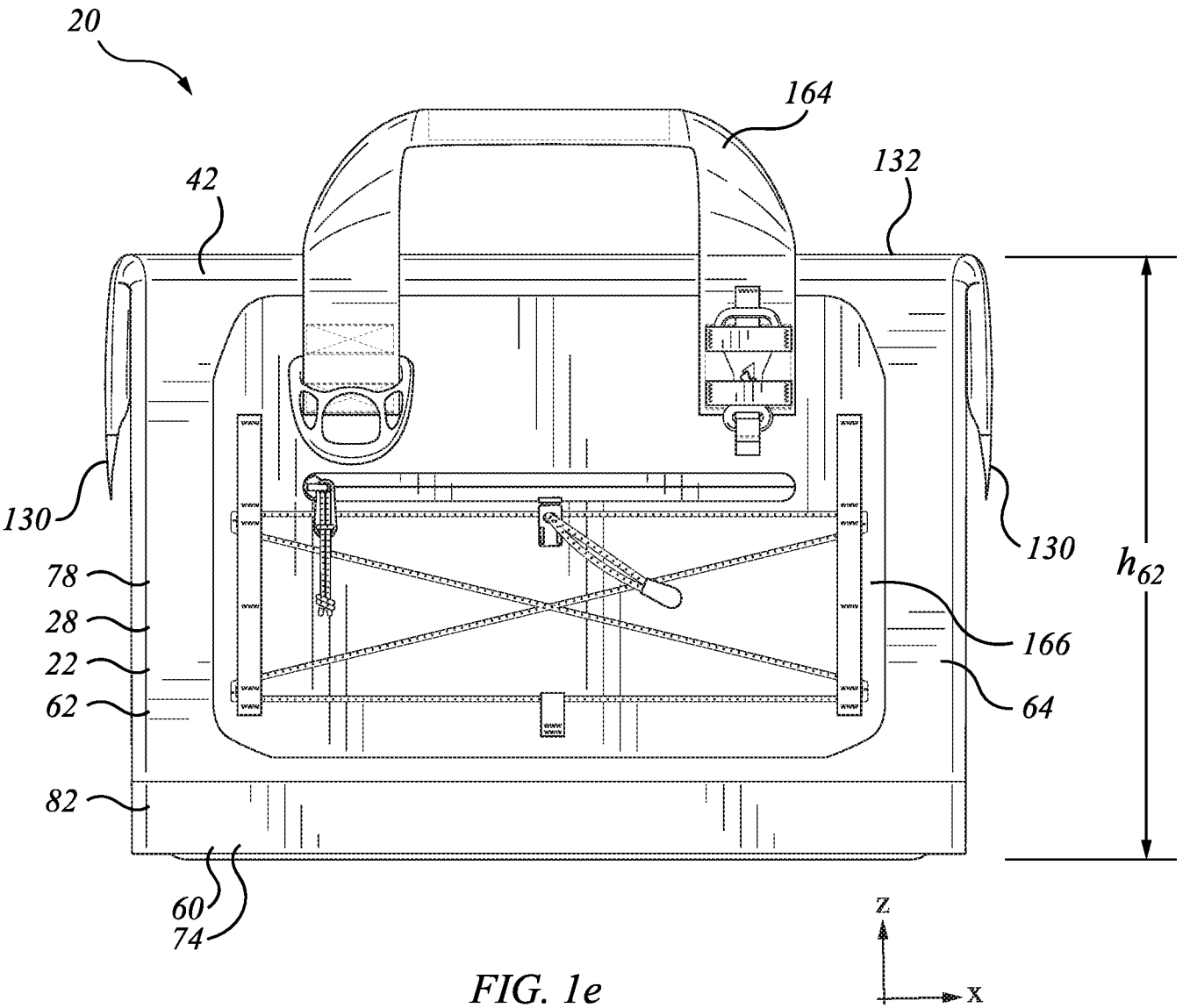
FIG. 1*e* is a front view of the container assembly of FIG. 1*a;*
Figure 1F:
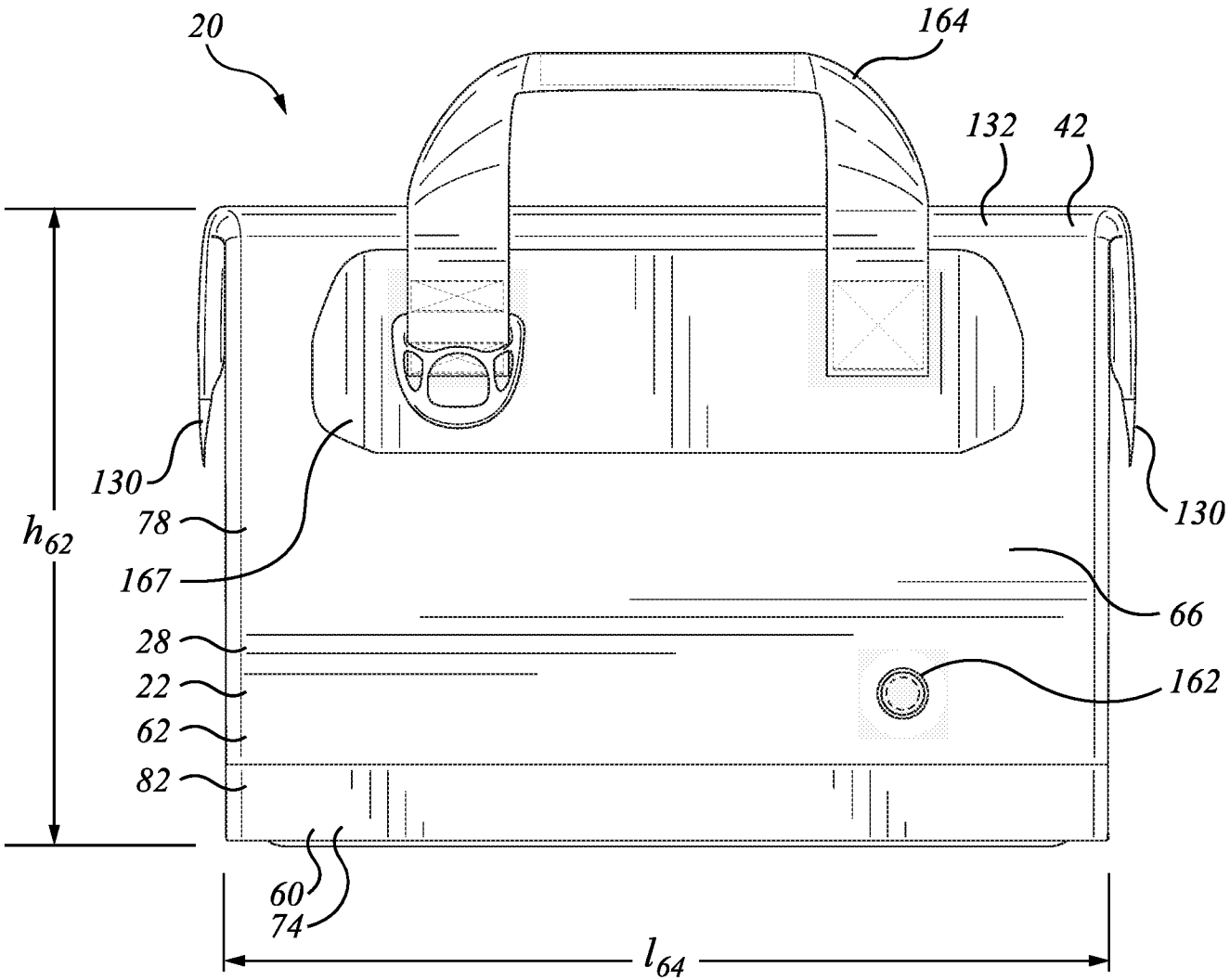
FIG. 1*f* is a rear view of the container assembly of FIG. 1*a;*
Figure 1G:
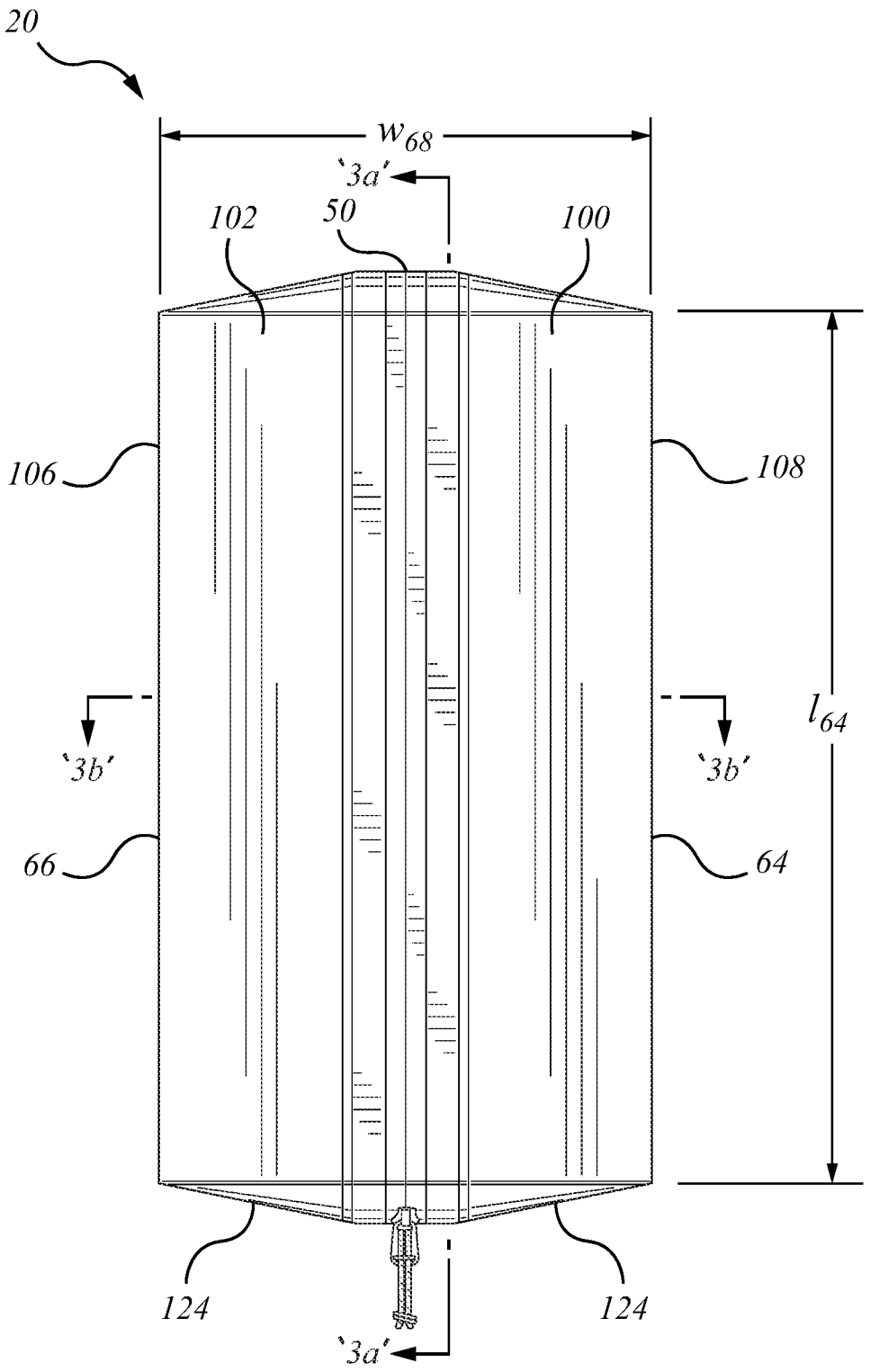
FIG. 1*g* is a top view of the container assembly of FIG. 1*a;*
Figure 1H:
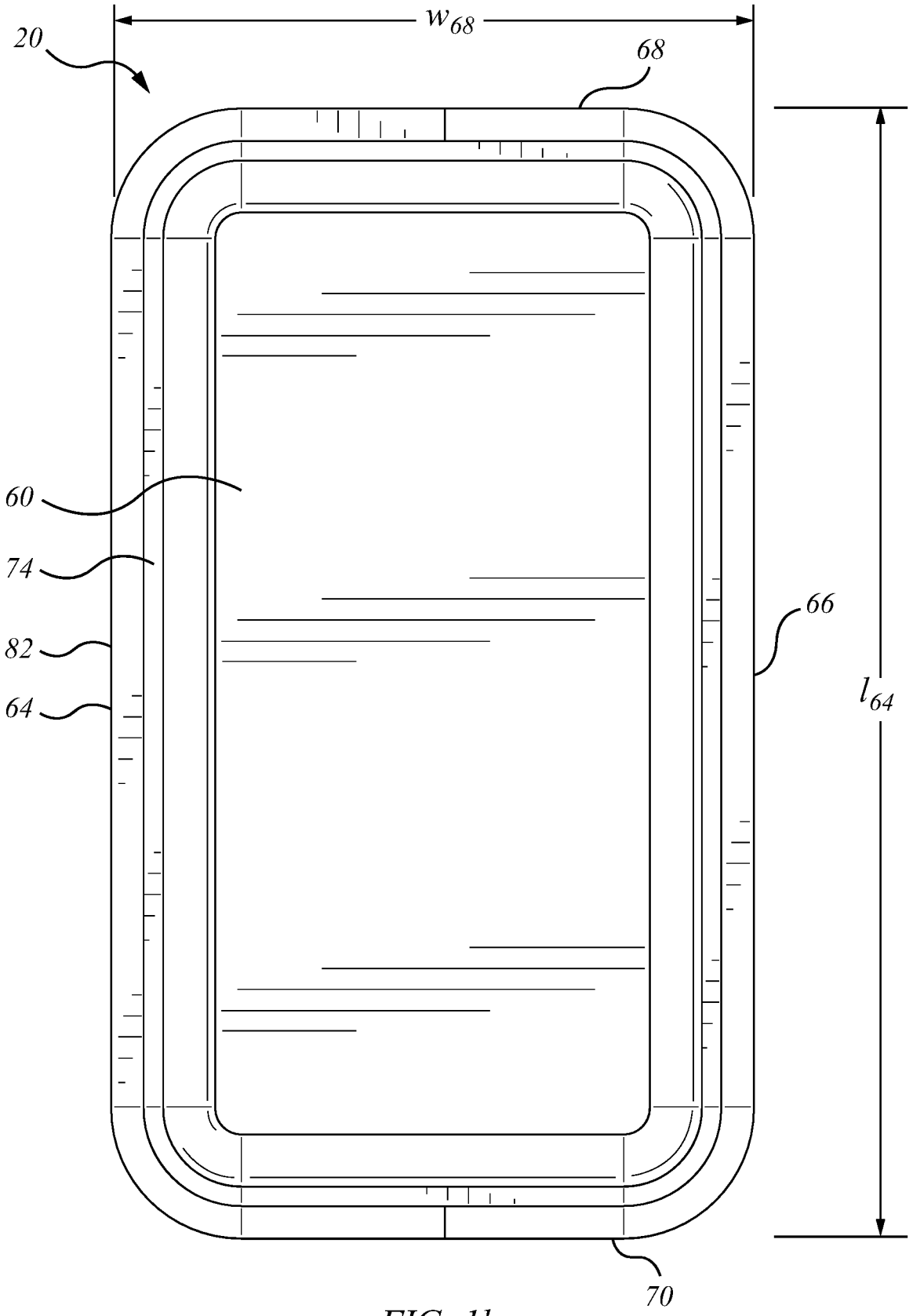
FIG. 1*h* is a bottom view of the container assembly of FIG. 1*a;*
Figure 1I:
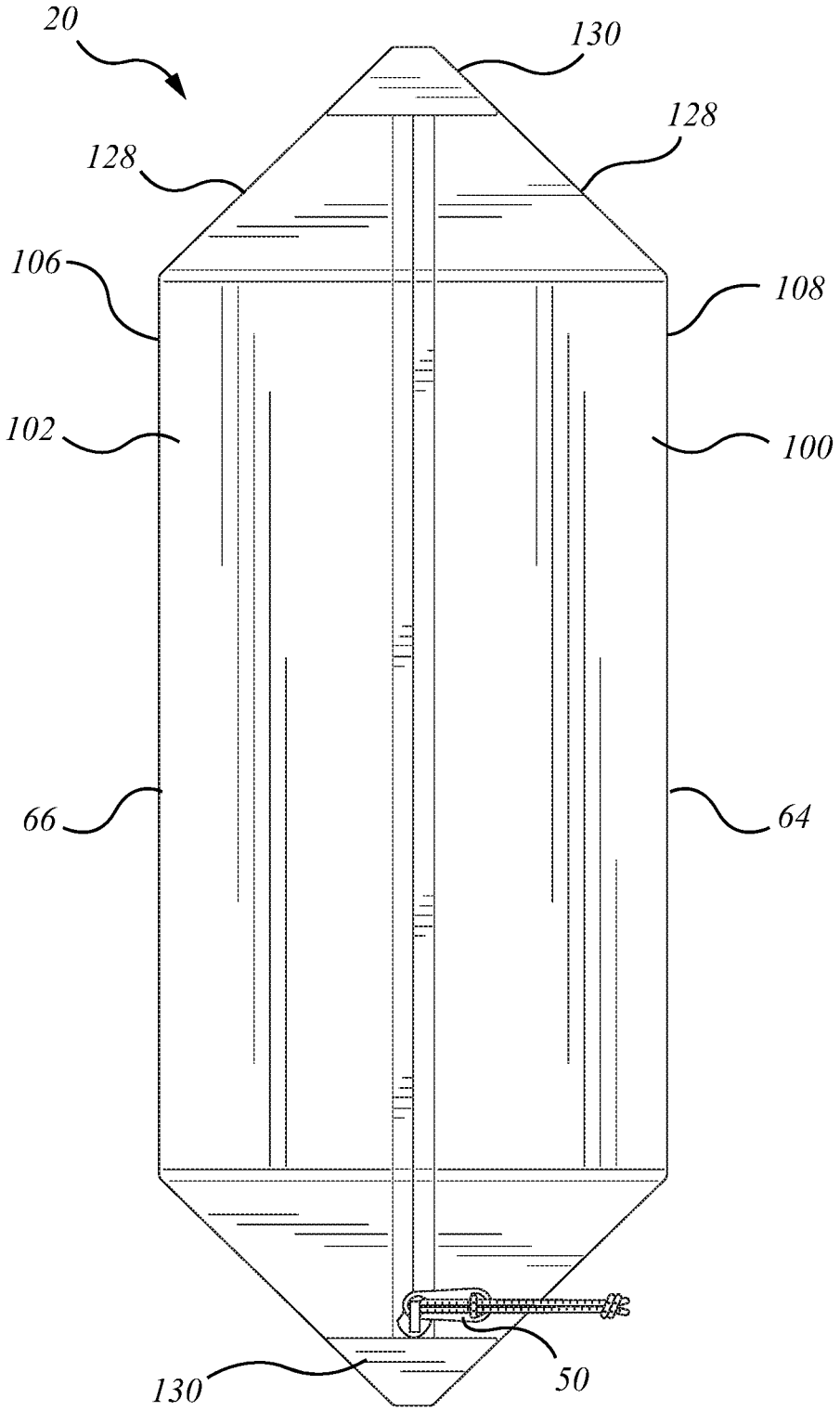
FIG. 1*i* is a top view of the container assembly of FIG. 1*a*, with end tips shown in a developed view as if in a flat plane.

Bottom wall 60 may be, or may include, an outer base or platform or relatively hard, wear-resistant material, such as a nylon or high density plastic exterior sheet. It may have molded feet or ribs or ridges or stand-offs, as at 74, upon which to stand container 20. The ribs or feet may be discrete, or they may have the form of a continuous rectangular ridge that extends around the rectangular shape. The ridge may be inset from the outside edge, as seen in FIG. 1*d*. Bottom wall 60 may also include a layer of insulation 76.

Side wall 62 may include an outer layer 78, and a layer of insulation 80 mounted inside outer layer 78. Outer layer 78 may be made of a single seamless sheet of material, such as a rubber sheet that has been formed as a cylinder. Alternatively it may be made of a rectangular or trapezoidal, or other shaped sheet that is wrapped about first portion 28 with its ends joined, e.g., as by welding. The welding may be radio frequency or RF welding (sometimes also called HF, or high frequency welding), or it may be heat welding, or ultrasonic welding In either case, outer layer 78 may form a waterproof barrier, and may be made of, or may be coated with, a scuff-proof material.

Insulation 80, whether made of a single piece or an assembly of pieces, or a cylindrical sheet, may extend about the entire periphery of sidewall 62, such that a continuous layer of insulation is formed around chamber 24. In the embodiment shown, sidewall 62 may be made of two pieces of equal size, with their edges overlapped and lap-welded together along the vertical central centerline of the ends of container assembly 20. Insulation 80 may be secured to outer layer 78 by a strip of hook-and-eye fabric fasteners (sometimes sold under the brand name "Velcro" ™), which may be mounted along the upper edge of outer layer 78. An additional securement may be provided by a similar attachment along the lowermost margin of out layer 78. Insulation 80 and insulation 76 co-operate to form an open-topped space. A cuff or strip 82 may be sealed to the peripheral margin of bottom wall 60 and the lower margin of sidewall 62. Strip 82 may be welded in place e.g., by RF welding, such that the outer wall of body 26 is waterproof. A liner 90 is inserted within the space defined inside insulation 80 and insulation 76. Liner 90 may be made of a waterproof nylon sheet. The upper margin of liner 90 and the upper margin of sidewall 62 may be sealed together, such as by welding.

Liner 90 may include a bottom sheet or bottom portion 84, that forms the inside layer of bottom wall 60. Liner 90 may also have an upstanding sidewall or sidewall portion 86 that extends upwardly from the margins of bottom sheet or portion 84. Sidewall 86 is a continuous peripheral wall or sheet or membrane, or web. Sidewall 86 of liner 90 also defines the inner layer, or layers of each of the long and short sidewall portions. The various long and short side wall portions of upper margin 88 of liner 90 are mated with the corresponding upper margins or edges of outer sidewall layer 78, thereby capturing insulation 80 between the inner and outer layers or membranes. Liner 90 may be made of a rubber or rubberized material that is waterproof such that liquids contained within chamber 28 may tend not to leak.

As so constructed, in plan view sidewall 62 of main body 26 is rectangular, having a length and a width. In this case, the generally rectangular shape has radiused corners. The resultant structure may have the form of a five-sided open topped box. Hood or cap 32 is mounted to that open-topped box.

Figure 2A:
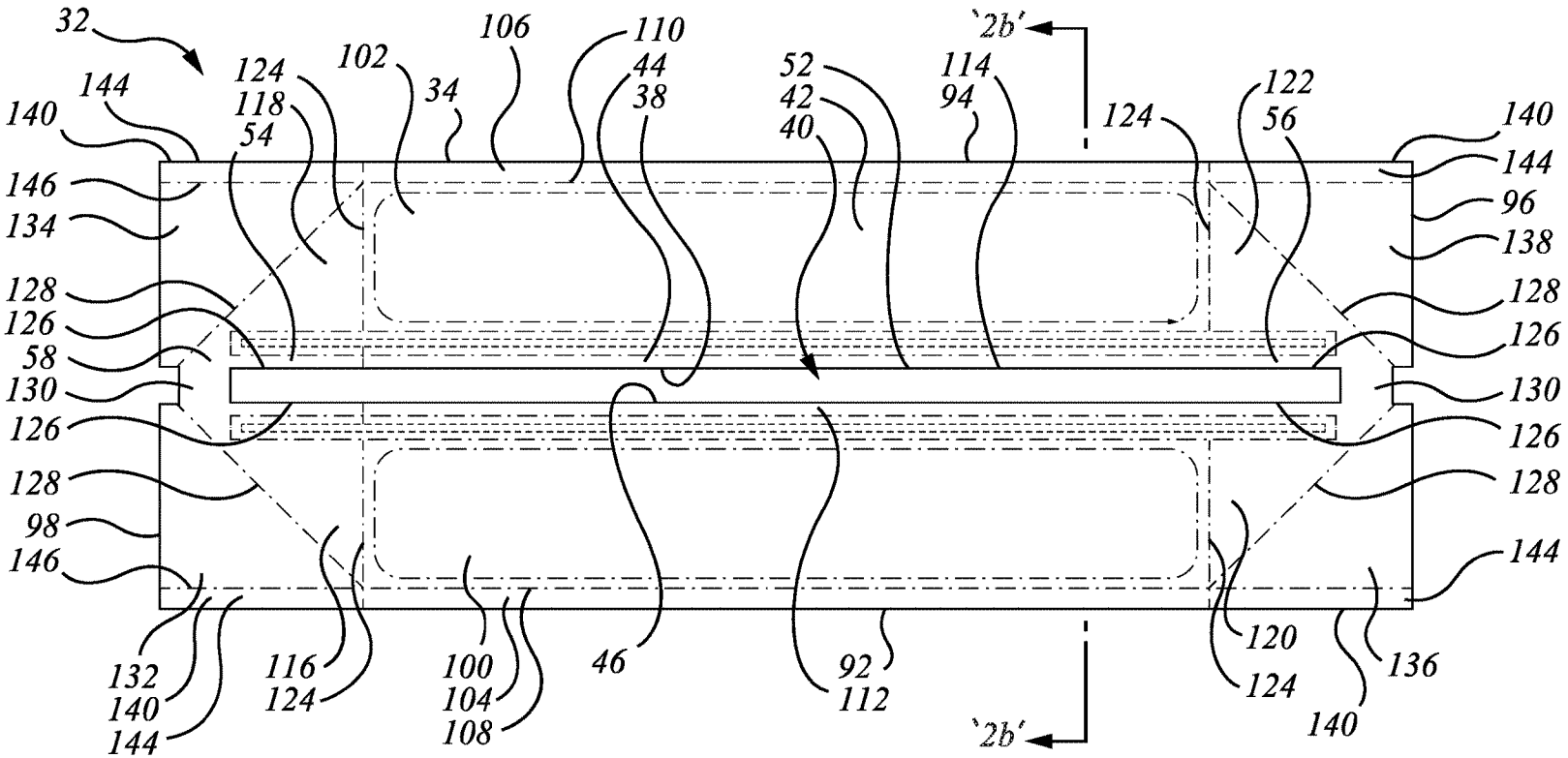
FIG. 2*a* is a developed view of the cap or closure assembly of FIG. 1*a;*
Figure 2B:
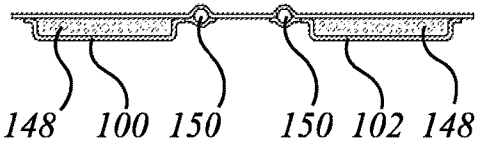
FIG. 2*b* is a cross-sectional view of the wall structure of the container assembly of FIG. 1*a*; taken on section '2*b*-2*b*' of FIG. 2*a;*

Looking now FIG. 2*a*, hood or cap 32 outer periphery 34 has portions or segments 92, 94, 96 and 98 that correspond respectively to the long and short side upper margins of wall portions 64, 66, 68 and 70. Hood or cap 32 inner periphery 38 that has a length that corresponds approximately to the overall peripheral length of first periphery 34. That is, the length of each of segments 44 and 46 of second periphery 38 is greater than the length of long sidewall portions 64, 66, such that path length tracked fastener 50 from end to end is also longer than those portions. Skirt 42 has two generally rectangular portions 100, 102. Portions 100, 102 have respective pairs of long side and short sides. Portions 100, 102 have respective outer edges or outer edge portions 104, 106 that run along their outside long sides, and that mate with the respective upper margins of long sidewall portions 64, 66. Outer margins or edges 104, 106 may be thought of as tabs, or strips, or hems, that overlap, and are mated to the margins of sidewall portions 64, 66 by such means as welding, to form a sealed connection or joint. That connection bends to define a flexible fabric hinge, to permit edges 104, 106 to bend relative to portions 100, 102 as the hood or cap 32 of the container assembly 20 is opened and closed. The respective folds, or fold lines, are indicated as 108, 110.

Along their inner long sides, portions 100, 102 also have inner edges or margins 112, 114 that mate with tracked fastener halves 48 and 49 respectively. This may be done by lapping margins 112, 114 over the side margins of the fabric webs of the zipper halves, and welding them together. This may yield a waterproof joint.

At the short side ends of portions 100, 102 are generally triangular portions 116, 118, 120, 122 that have one edge merging into portion 100 or 102, as the case may be, at a fold 124; a further edge 126 that mates with the portions of margin segments 44 and 46 that extend lengthwise beyond portion 100 and 102, i.e., beyond fold 124; and an hypotenuse defined by, or defining, a fold line 128 that runs diagonally between the ends fold 124 and edge 126 to form the final edge of the triangle. The end tips of each pair of portions 116, 118 and 120, 122 are joined together by a connection, end piece, or web 130.

Skirt 42 has four further generally triangular flaps or gussets or portions 132, 134, 136, 138. Each of those gussets has a first margin running along the respective hypotenuse defined by fold line 128; a second margin 140 that is an extension of long outer margin 104 or 106, as may be; and a third margin 142 that, when folded, underlies margin or edge 126 and is sewn to the opposed margin 142 of the opposite flap or gusset or the pair of gussets at that end of hood or cap 32, i.e., the pair being 132 and 134; and 136 and 138. Edges, or tabs, or hems 144 extend along the respective margins 140, and are mated to the respective upper margins of short side portions 68 and 70 that form the ends walls of main body 26. This mating may be by welding, and may yield a waterproof seal. Hems 144 meet the various respective gussets at fold lines 146.

Figure 3A:
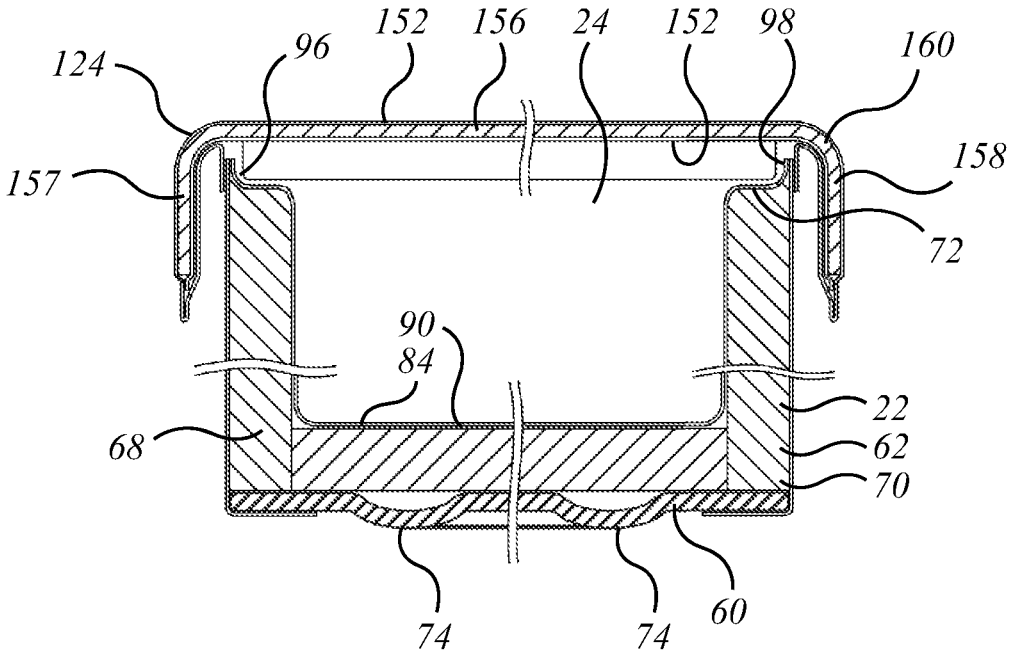
FIG. 3*a* is a lengthwise fore-shortened section of the container assembly of FIG. 1*a* on section '3*a*-3*a*' of FIG. 1*g* through the midst of a closure stiffener.
Figure 3B:
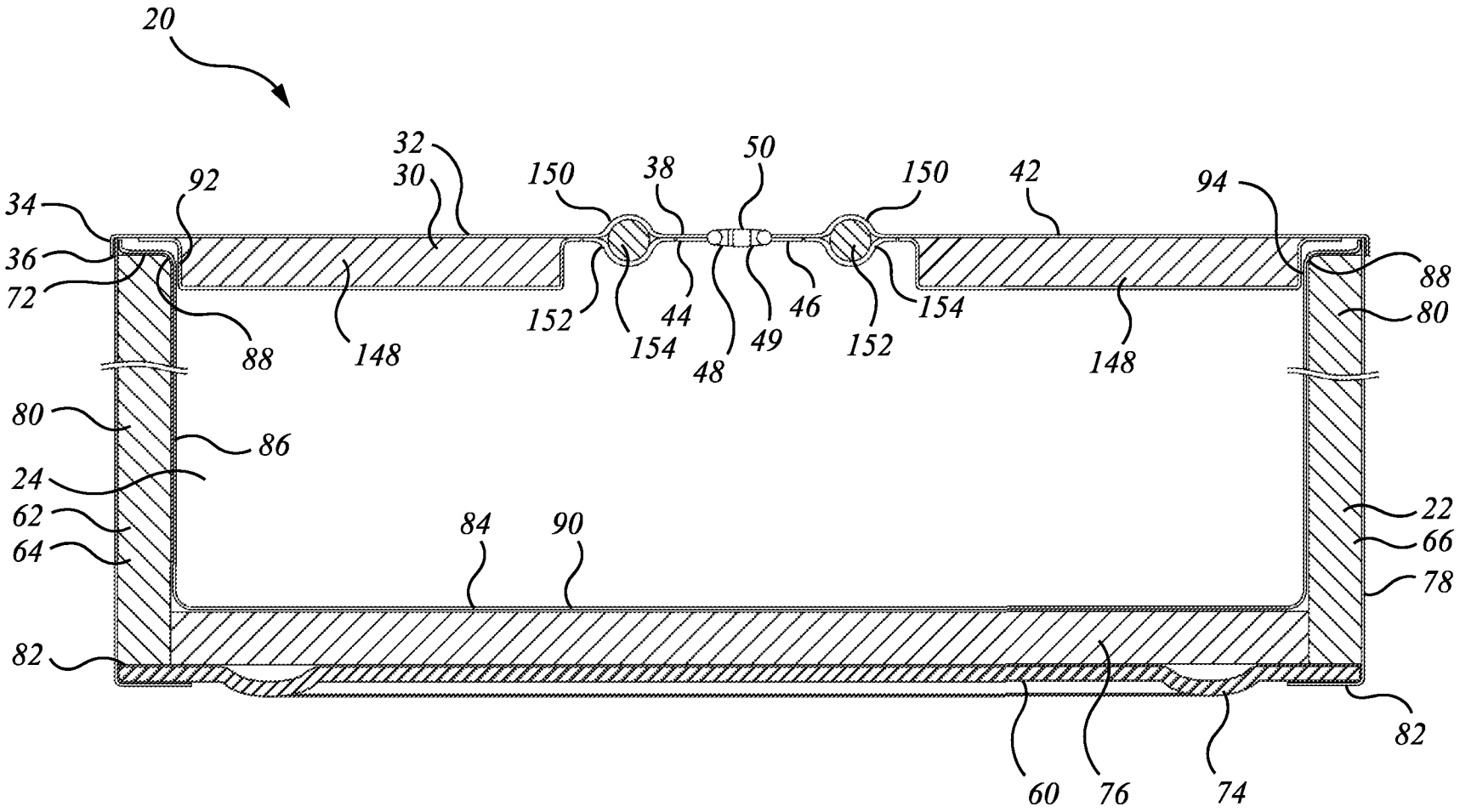
FIG. 3*b* is a cross-wise foreshortened cross-sectional view of the container assembly of FIG. 1*a* taken on section '3*b*-3*b*' of FIG. 1*g;*

As can be seen, the outer periphery 34 of hood or cap 32 is joined to the upper margin or periphery 72 of main body portion 28 along hems 144 along first and second short side portions 68, 70, and along hems or edges 126 joined to long side portions 64, 66. For the purposes of this discussion, the sum of the lengths of hems 144 and 126 is equal to the total length of upper periphery 72. Outer periphery 34 exceeds the length of upper periphery 72 by the lengths of edges 142 and the width of webs 130. In the embodiment of FIG. 2*a* and FIG. 3*b*, insulation 148 may be mounted to portions 100, 102. Insulation 148 may be mounted on the inside face of portions 100, 102, for example, with an internal covering layer 149 welded to the surrounding webbing of portions 100, 102. Separate insulation pads or portions 148 are shown in the embodiment of FIGS. 2*a* and 3*b*.

Figure 3C:
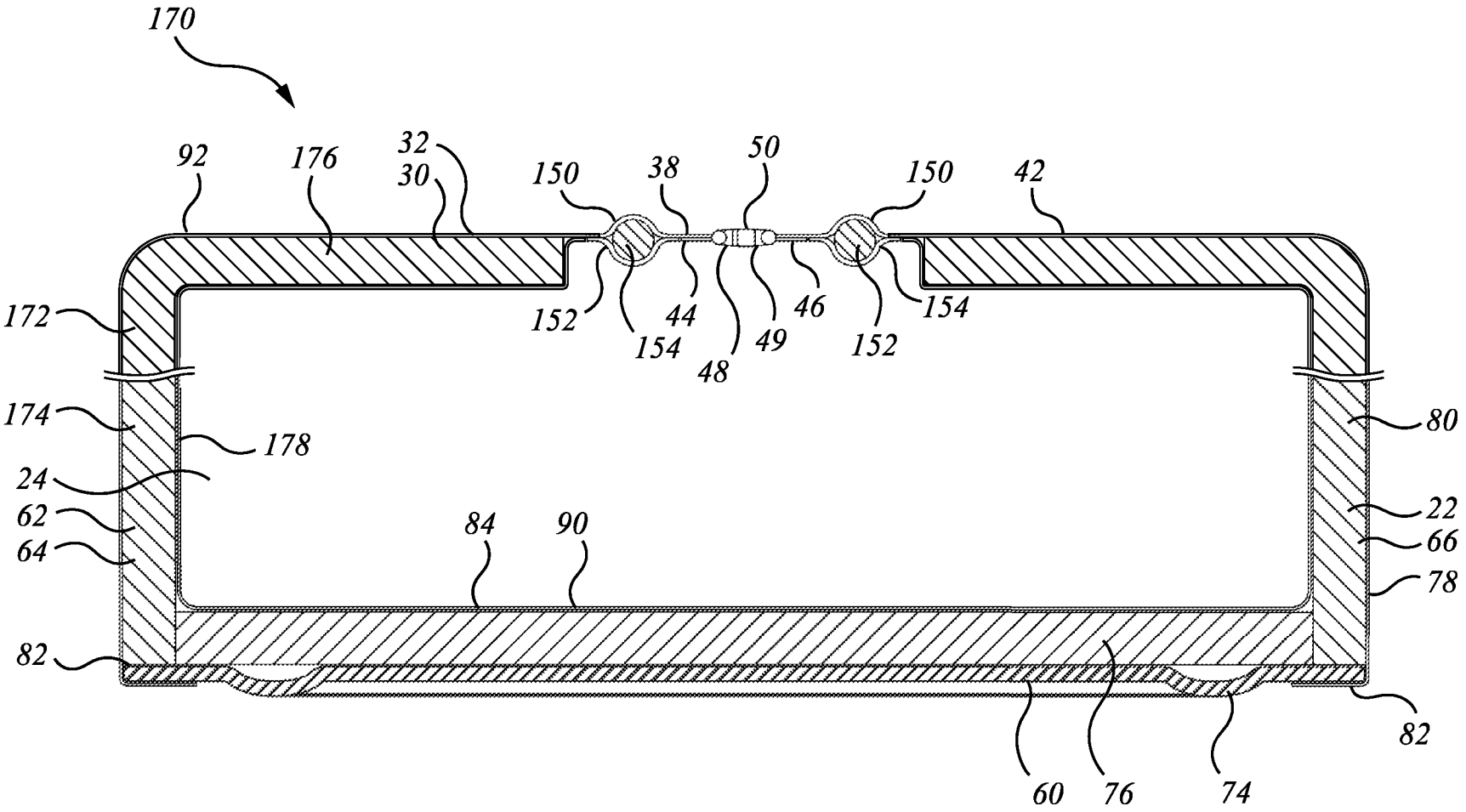
FIG. 3*c* is an alternate embodiment to that of FIG. 3*b* in which the side wall insulation runs continuously into the top wall.
Figure 3D:
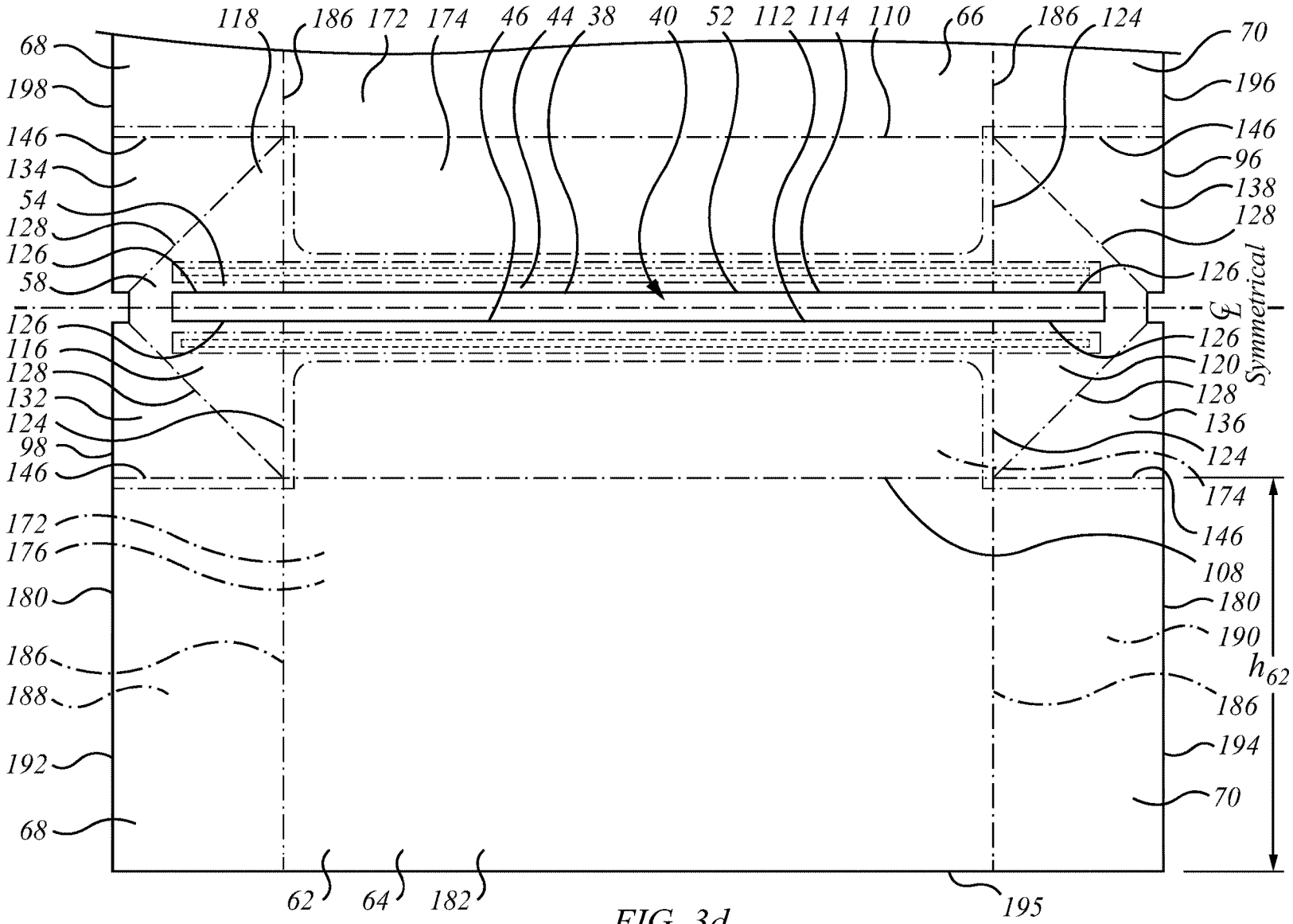
FIG. 3*d* is a developed partial scab view in plan of more than half of the wall structure of FIG. 3*c*, that structure being symmetrical about the centerline.

In the alternate embodiment of FIGS. 3*c* and 3*d* the insulation 151 of the side wall portions is carried continuously into the top wall, and the welded seam of the liner is made in the top wall inboard of the edge of insulation 151. The outer skin may then be continuous, without a weld, i.e., the outer skin of the cap and the outer skin of the body may be made of a continuous sheet from bottom wall 60 to tracked fastener 50.

A reinforcement, or stiffener, or frame member, or former, however it may be called, is indicated as 150. It may include a stiffening beam, or spring, or leaf, or batten, or wire, or stiffening rod 152 captured in place with a covering web 154, the wings of the covering web being mounted to the inside face of hood or cap 32 running along segments 44 and 46 of opening 40. The ends of the stiffening wire may be capped to prevent the raw metal ends of the bag from being ripped during repeated use over time. Reinforcements 150 may be mounted beside the zipper halves, i.e., the respective halves 48 and 49 of tracked fastener 50. Stiffening rod 152 has a middle portion 156, and end portions 157, 158. Middle portion 156 has a length corresponding to the length of rectangular portions 100, 102. End portions 157, 158 may have a length that corresponds to the remaining length of segments 44, 46 that extend beyond fold lines 124. End portions 157, 158 are bent relative to middle portion 156. End portions 157, 158 may be bent roughly at a right angle to middle portion 156, or less than a right angle, such that a U-shape is formed. Stiffener 150 can be understood to define a jaw, or jaw bone, 160 of the mouth of container assembly 20 defined by opening 40.

In the closed position of opening 40 seen in FIG. 1*a*, the U-shaped jaws 160 are closed. That is the two U-shapes are placed closely next to each other, in an upright, vertical, or predominantly vertical orientation in which the U-shapes lie in, or lie close to being in, parallel vertical planes, those planes being spaced apart by roughly the width of tracked fastener 50. In this orientation, the U-shapes open downwardly. Also in this position, it can be seen that the sub-assemblies of the various triangular end flaps and gussets lying beyond folds 124 are folded over on each other, and form triangular tips that point predominantly toward bottom wall 60, which typically means downwardly when container assembly 20 is standing upright.

In the open position of FIG. 1*b*, jaws 160 are open. That is, the respective end legs are angularly displaced away from the corresponding member of the opposite jaw such that middle portions 156 are separated. In the opening motion of this embodiment, that angular displacement, or rotation of the various pairs of opposed legs or end portions 157, 157 and 158, 158 is such that, when container assembly 20 is seen in end view, middle portions 156 are rotated upwardly and outwardly away from each other to reach the position seen in FIG. 1B, in which portions 100, 102 are standing in their open, upright, or predominantly upright orientation. That is, in the closed position middle portions 156 are moved together, and in the open position they are moved apart. Webs 130 function as fabric hinges in this motion. Since they are fabric, and flexible, and since the ends of the various members 157, 158, the opposing jaws are able to float relative to each other, as opposed to being held by a fixed mechanical hinge pin on a fixed axis of rotation. Expressed differently, in these embodiments, the jaw bones defined by stiffeners or reinforcements 150 are not joined to each other. Rather they float, as permitted by the flexible web hinges, and are retrained in the closed position by the securement of the closure member, such as tracked fastener 50. The spacing of the float, when closed, may be wider than the width of tracked fastener 50 such that the actual connection, and the connection of the jaw bone, when closed, is through the medium of the flexible webs of the fastener portions, such as the zipper halves. Those webs may tend to be under tension when closed. In this example, in the closed position, there is no rigid connection between the jaw bones. They do not snap together as inter-engaging molded rigid plastic parts.

In the open position, the various triangular gussets and flaps unfold, to approximate a continuous upstanding end-wall extension of portions 68 and 70 of peripheral wall 62 of main body 28. The resultant opening may tend to be rectangular, or approximately rectangular; and may tend to be the same size, or approximately the same size, as the upper opening of the five-sided box defined by main body portion 28. To the extent that the bends in stiffener 150 are not fully square, or to the extent that stiffener 150 is springy (i.e., resilient), and the corners are deflected from square, the opening of the ends may yield a slightly hexagonal form. That is, the length of portions 57, 58 of the jaw bones when added together is the same, or about the same, as the length of the upper margins of short side portions 68 and 70. In this motion, the second periphery of hood or cap 32 is opened and closed by opening or closing tracked fastener 50. Tracked fastener 50 has a length that exceeds the length of the rectangular wall structure as defined by the length of portions 100, 102.

In the embodiment described, insulated container assembly 20 may be welded at all seams, and that welding may be RF welding. As described above, the second periphery has a first margin and a second margin, and a tracked fastener having corresponding first and second portions mounted to aid first and second margins respectively. Also as described, the first and second margins each have a stiffener mounted thereto, said stiffener running lengthwise.

Container assembly 20 may also include an air vent or pressure relief valve, or purge valve 162, such as mounted in the rear wall portion, first and second handles 164, themselves mounted to front and rear wall load spreaders, or doublers 166, 167, such as may be made of thicker rubber or rubberized sheets welded to portions 64 and 66 respectively, and such as may mount an external pocket, such as for holding documents; and external strapping 168, such as may have the form of elasticised cords. The doublers are welded to the outer skin of container assembly 20 all around their peripheries, and all around the roots of handles 164.

In the embodiment of FIGS. 3*c* and 3*d* a container assembly 170 may be taken as having the same structure, materials, and assembly techniques as container assembly 20. It differs in that insulation 172 of the side wall portions 174 is carried continuously into the top wall portions 176, and the welded seam 180 of the liner 178 is made in the top wall inboard of the edge of insulation 172, next to the edge of the cover of stiffener 150. The outer skin 182 may then be continuous, without a weld from the base almost to the zipper. That is, there is no weld or joint at the top corner of the sidewall as there is in FIG. 3*b* at items 74 and 92, i.e., the outer skin of the cap and the outer skin of the body may be made of a continuous sheet from bottom wall 60 to tracked fastener 50. A nominal fold line 184 is retained to symbolise that the top portion 176 continues to fold and unfold relative to side wall portion 174.

The folding triangular portions 116, 118, 120, 122 and 132, 134, 136 and 138 remain as before, except that the welding tabs, namely folding edges or hems 144, and long side folding edge portions 104, 106 are not employed, because the fabric, or membrane of the wall sheet material of side wall portions 174 is continuous at the bend such that no weld is required. Bend 124 has a corresponding bend or corner 186 that corresponds to the bend between long side portion 64 or 66, and each respective half 188, 190 of a short side portion 68 or 70. The vertical edge margins 192, 194 of halves 188, 190 mate with, and are joined to the edge margins 196, 198 of the opposite half. The bottom edge or margin 195 follows the generally rectangular, rounded-corner plan form of bottom wall 60, as before, and is mated thereto.

In either the embodiment of FIG. 1*a* or the embodiment of FIGS. 3*c* and 3*d*, in the closed position container assembly 20 or container assembly 170 has a generally 6-sided cuboid box shape, having a height $h_{62}$ to the top corner of the sidewall, a width $W_{68}$ measured cross-wise to the end faces, and a length $L_{64}$ measured over the large front or rear face. When the hood or top is opened, the parts of the closure assembly unfold upwardly. As such the opening may tend to resist spillage of the contents of interior chamber 24 during opening and closing.

Whether for container assembly 20 or container assembly 170, the upper and lower portions of the container assembly, namely the lower portion or main body 28 and the upper portion or closure assembly 32 may be defined in terms of being either below or above the various folds 108, 110, 124. The lower portion is the stationary or fixed configuration portion, and the upper portion is the moving or changing configuration portion.

When the upper portion of the container assembly is closed, it forms a hood or cap or cover, or top wall of the container, generally. When the upper portion is fully unfolded it forms a sleeve, or chute, or cuff, extension or mouth of the upstanding sidewall, reaching beyond the height $h_{62}$ of bend line 108 or 110 or 124. Whether the hood is formed separately and then welded on, or is formed integrally as in FIGS. 3*c* and 3*d*, the second periphery can be thought of as being defined by the various fold lines about the top of the container assembly defined by folds 108, 110 and 124. In the embodiments of FIGS. 1*a* and 3*c*, it may extend up to half of the magnitude of width $W_{68}$ above bend line 108, 110 or 124. The resultant opening may tend to be greater than half the area of $W_{68} \times L_{64}$, and in the embodiment shown may be roughly the same as $W_{68} \times L_{64}$, and approximates the plan form of bottom wall 60. As noted, the path length of tracked fastener 50 is greater than the length of the box-shape, represented by $L_{64}$ and the total length of the second periphery is greater than twice $L_{64}$, but less than twice $(L_{64}+W_{68}/2)$.

Figure 4A:
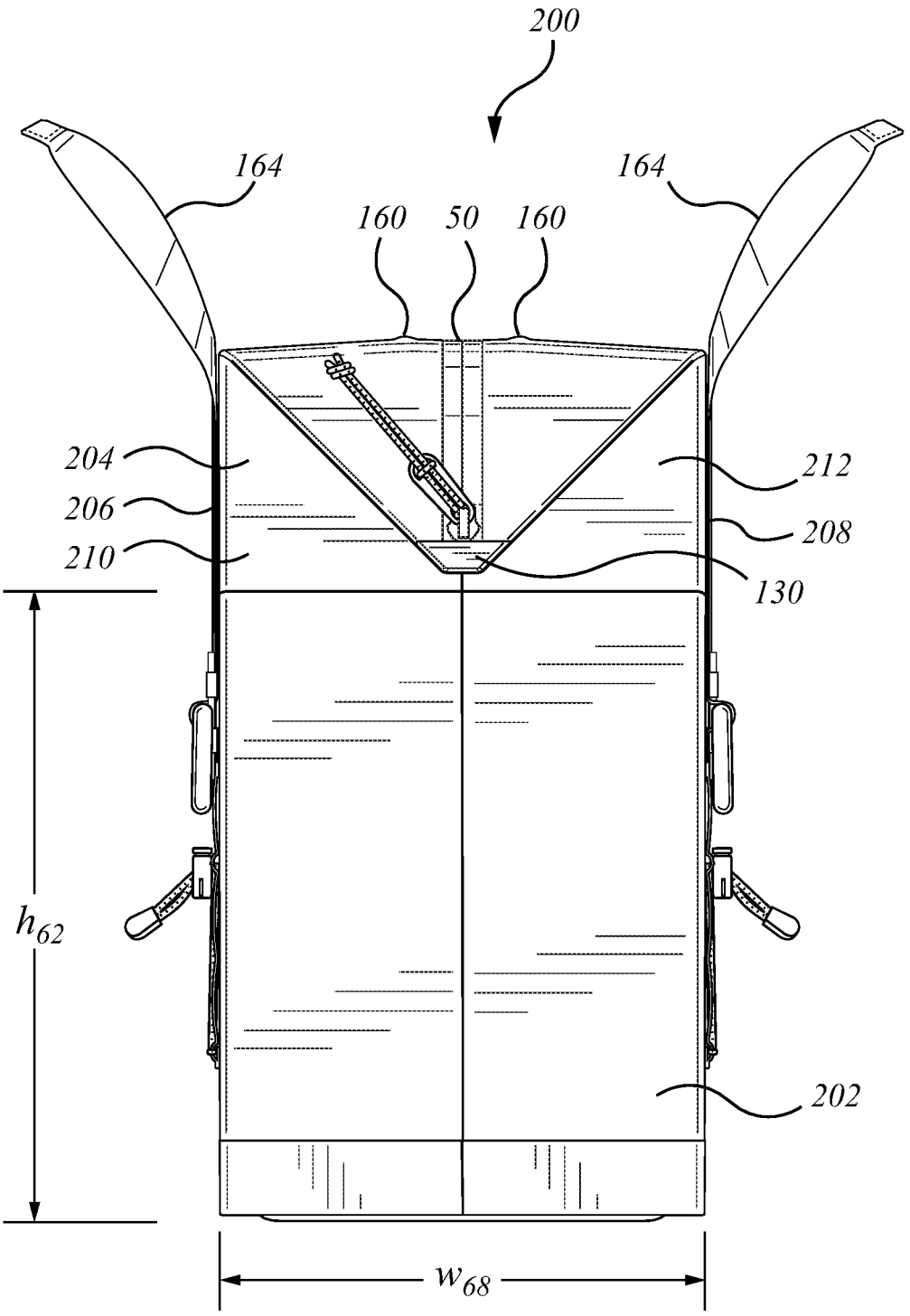
FIG. 4*a* shows an end view of an alternate embodiment of insulated container to that of FIG. 1*a* in the closed position.
Figure 4B:
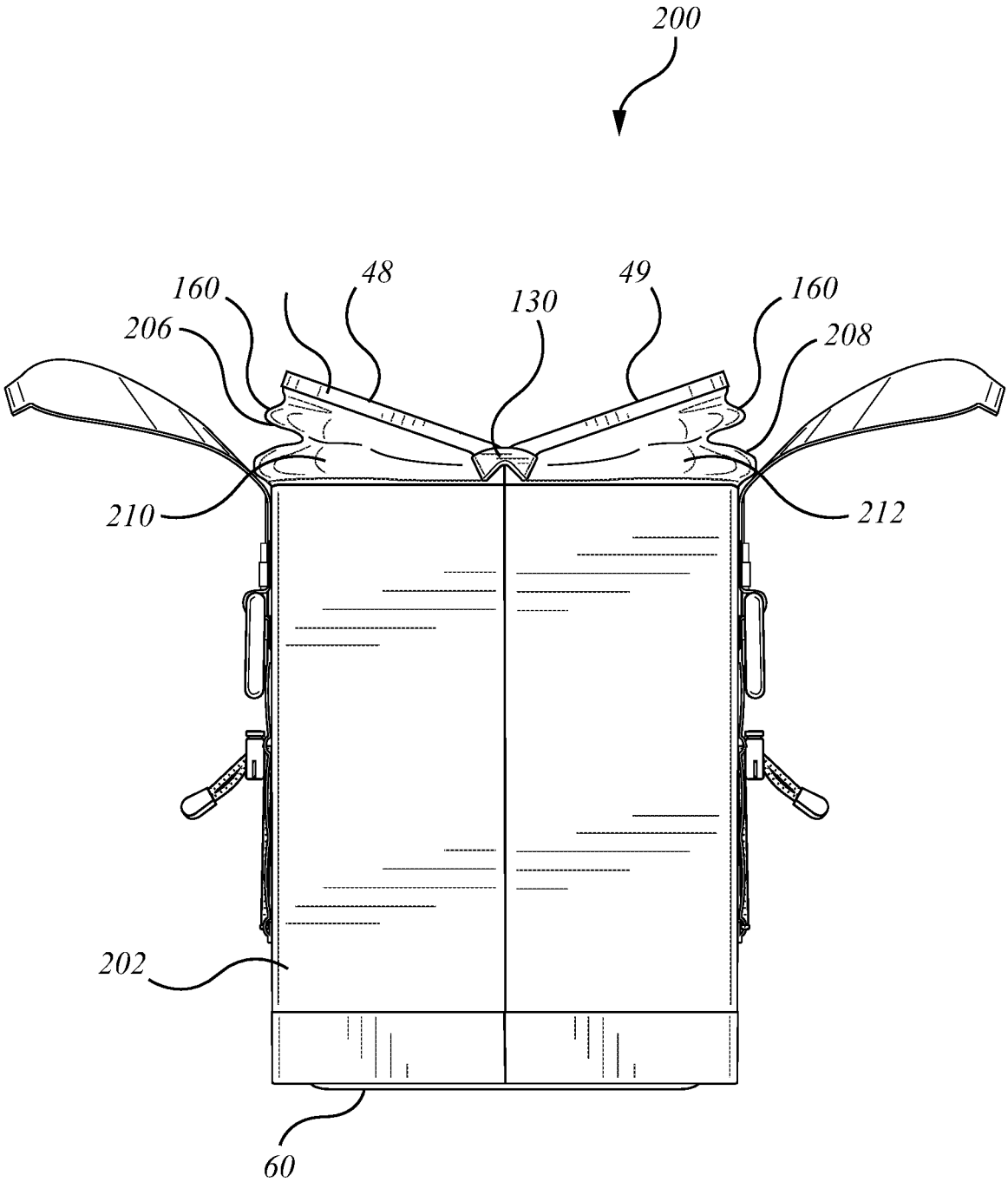
FIG. 4*b* shows an end view of the insulated container of FIG. 4*a* in a open position.

The embodiment of FIGS. 4*a* and 4*b* may be understood to be of the same type of soft-sided, welded, insulated container construction as the embodiment of FIGS. 1*a* and 1*b*, unless otherwise stated. As such, the foregoing description applies. As seen in FIG. 1*c*, and if when container assembly 20 is closed and secured by tracked fastener 50, container assembly 20 has a relatively compact, generally cubic shape, and the top panel is generally flat and horizontal, such that two or more such containers might be piled on upon another. However, in the embodiment of FIGS. 4*a* and 4*b*, rather than the mouth of the insulated container lifting upward and outward, it opens outward and downward. That is, insulated container assembly 210 has a main body 212, and a hood or cap assembly 214. However, in contrast to cap assembly 32, when cap assembly 214 is in the closed position, wall portions 216, 218 are not substantially co-planar (as are portions 100, 102), at roughly the level of the upper margin of main body 26, but rather are inclined or stretched, or unfolded, upwardly and inwardly toward each other. In the open position of FIG. 4*b*, the jaw bones 160 rotate outwardly and downwardly, with wall portions 216, 218 folding and collapsing outwardly on themselves, with triangular end gussets 220, 222 similarly folding on themselves.

Figure 5A:
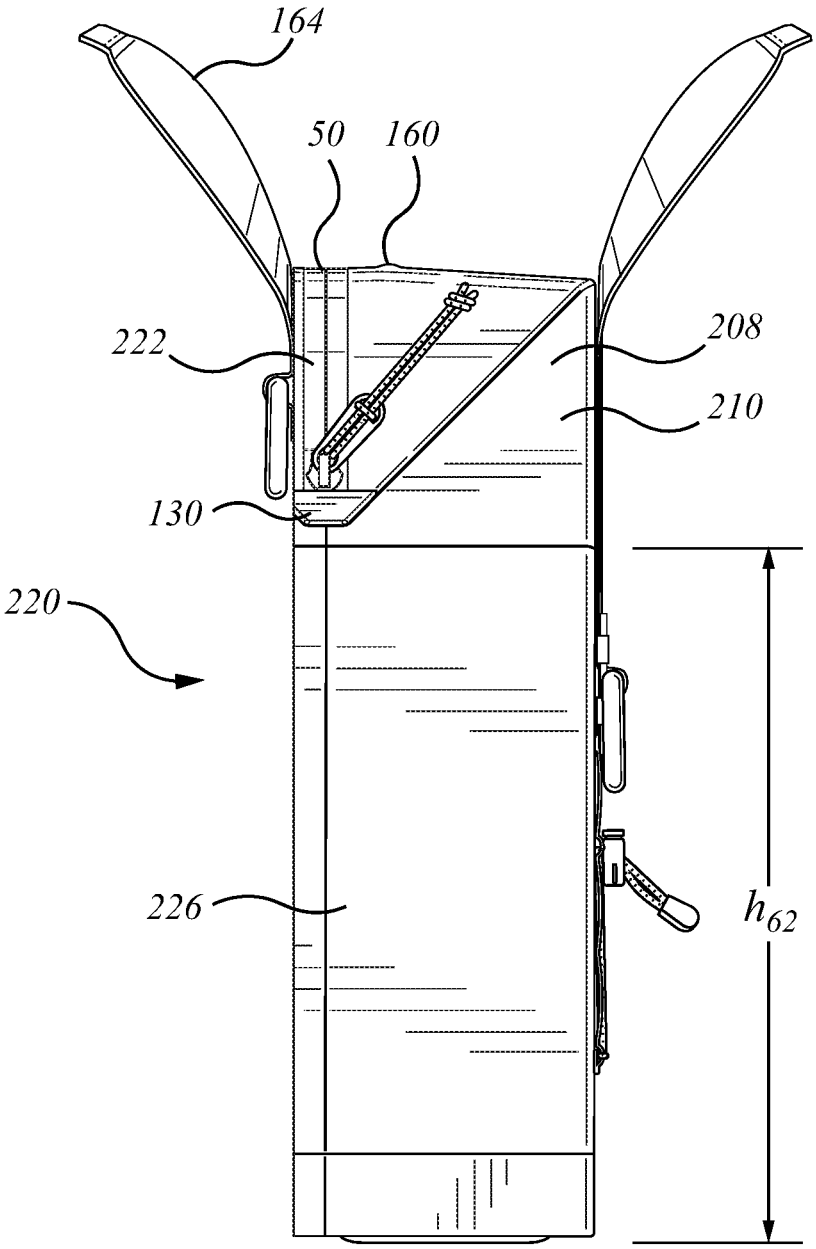
FIG. 5*a* shows an end view of an alternate embodiment of insulated container to that of FIG. 1*a* in the closed position.
Figure 5B:
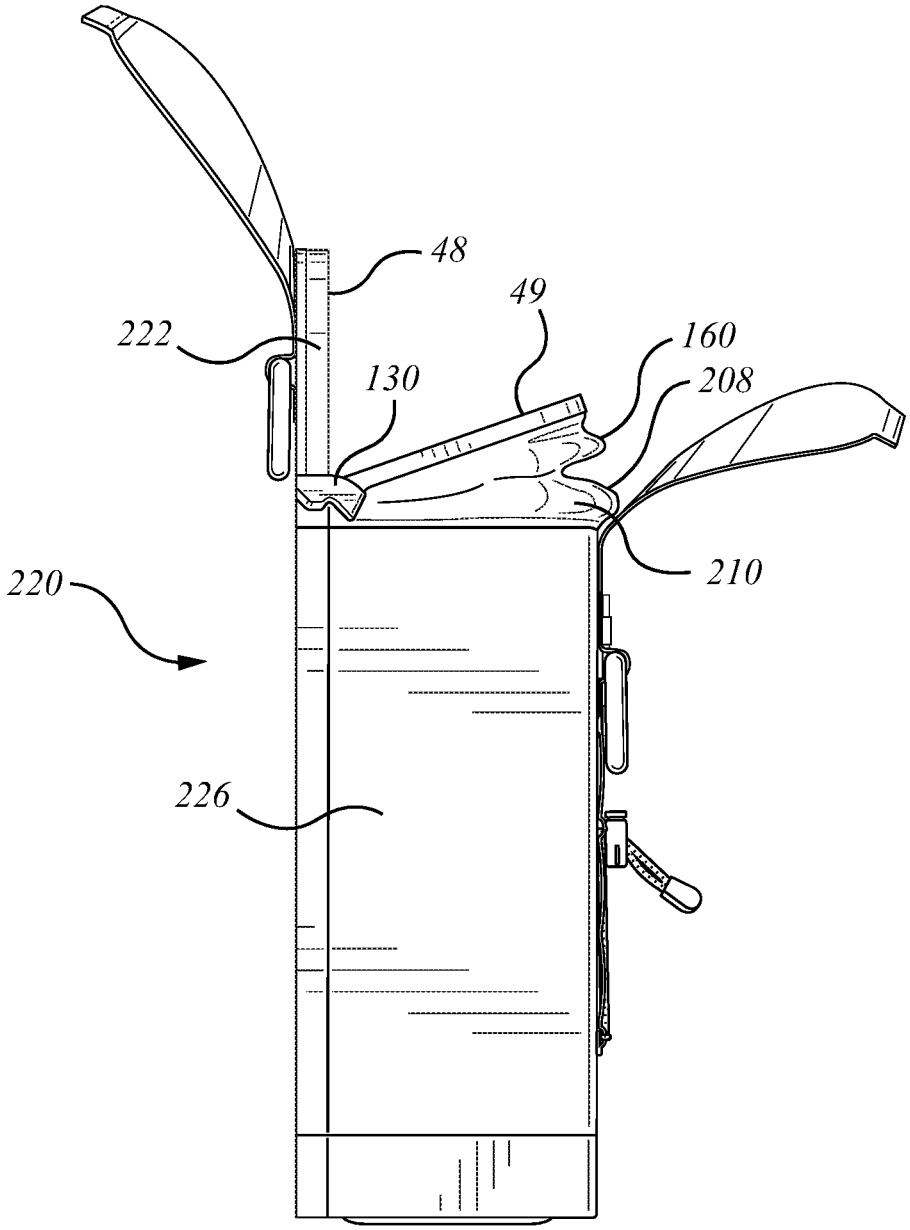
FIG. 5*b* shows an end view of the insulated container of FIG. 5*a* in an open position.

The embodiment of FIGS. 5*a* and 5*b* is substantially similar to the embodiment of FIG. 4*a*, but rather than having two mating halves of the hood or cap, it has a single hood, or half-hood, that folds outwardly and downwardly, while the other side of the closure does not move. That is, in container assembly 230, on one side main body 232 has an main wall extension 234 on one side, and a moving portion 236 defining a cap, hood, or mouth 238 on the other side, with a single jaw-bone 160 rather than a pair of opposed jaw-bones 160 as in the embodiments of FIGS. 1*a* and 4*a*.

In the embodiments of FIGS. 4*a*, 4*b*, 5*a* and 5*b*, the upper or moving portion of the container assembly may tend to form a dome or rounded or mitred cupola-shaped top. A flat, or flatter top or lid portion, as in container assemblies 20 and 170, for example, may tend more easily to facilitate stacking of the units for packing and storage.

A more general point can also be made in respect of the embodiments of FIGS. 1*a* and 4*a*, that although it is convenient and has the virtue of simplicity for the container assembly to have a hood or cap 32 that is two-sided and symmetrical, it is possible to arrive at folding geometries that are not symmetrical, as in the embodiments of FIGS. 5*a*, 5*b* and 6*a*, 6*b*.

In the embodiments described, however, the use of a moving jaw or jaw-bone, such as floating jaw 160 (or jaws 160) that moves (or move) from a position in which the jaw-bone goes from a closed orientation in which the width of the projected image of the jaw bone in the depth direction of the container is small or zero (e.g., as when sighting in the plane of items 154, 157 and 158) to a position in which the projected image of the plane is larger, in particular wider (e.g., as when sighting in a plane that is oblique or perpendicular to the plane of items 154, 157 and 158). The stiffness of the reinforcement then tends to hold the respective C-shapes of the haves of the opening to yield the generally rectangular overall shape. The floating j aw-bone may tend to provide a modest amount of stiffness, which may be helpful when operating the tracked fasteners, e.g., a stiff water-resistant or water-proof zipper, as may be; yet without requiring a pair of rigid plastic molded clasps or handles.

This structure and its operation may be contrasted with the opening of a zipper in the midst of a substantially stiff web, where the width of the opening is typically that of a thin slot, i.e., of the zipper, and if the user is trying to put something thicker or larger into the container, then the user needs at least one additional hand to hold the opening open wider. This issue may tend to arise with relatively stiff waterproof containers, where, although the container is nominally soft-sided, the waterproof membranes are actually fairly thick and fairly stiff. When the container is too stiff, it becomes cumbersome to use.

Where a jaw-bone arrangement is used, rather than the opening having the width of the slot, the opening has the potential width of the jaw-bones when they are in their maximum open condition, with the U-shape of the jaw fully extended. This typically yields a generally rectangular or D-shaped opening, rather than a slot.

The features of the various embodiments may be mixed and matched as may be appropriate without the need for further description of all possible variations, combinations, and permutations of those features. The principles of the present invention are not limited to these specific examples which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details, but only by the appended claims.

We claim:

1. An insulated container assembly comprising:

an insulated wall structure having a chamber defined therein;

said insulated wall structure including a main body of said container assembly, said main body having a rectangular bottom wall with radiused corners, and an upstanding peripheral sidewall extending upwardly from said bottom wall co-operating to form a five-sided open topped box;

said upstanding peripheral sidewall having an outer layer and a layer of insulation mounted within said outer layer, said outer layer extending around said insulation and defining a waterproof barrier;

said upstanding peripheral sidewall having a lower margin mated to said bottom wall and an upper margin distant from said bottom wall;

said main body of said insulated wall structure including a liner mounted within said insulation, and said chamber being defined within said liner;

said chamber having an opening;

said container assembly including a closure mounted to said insulated wall structure, said closure being movable between an open position and a closed position to govern access to said chamber;

said closure including a cap, said cap having a first periphery mated to said upper margin of said insulated wall structure, a second periphery defining an opening through said cap, and a skirt extending between said first periphery and said second periphery;

said second periphery having a first margin and a second margin;

said skirt being foldable;

said skirt having a layer of insulation located between said first periphery and said second periphery;

in said closed position of said closure, said first and second margins of said second periphery of said skirt of said cap being matingly secured to each other, and said skirt being at least partially folded; and in said open position, said skirt being more unfolded than in said closed position, and at least a portion of one of said margins of said second periphery of said skirt of said cap being located more distant from said wall structure than in said closed position;

said second periphery has a tracked fastener having corresponding first and second portions mounted to said first and second margins of said second periphery respectively, said first and second portions of said tracked fastener being mutually engaged when said closure is in said closed position;

in said closed position said tracked fastener running from end to end of said second periphery thereby securing said closure from end to end thereof;

said insulated main body of said container assembly having a length and a width and a depth, said length being greater than said width, said tracked fastener being mounted to run predominantly lengthwise relative to said insulated main body of said container assembly;

at least said first margin of said second periphery of said skirt of said cap has a first stiffener mounted thereto, said first stiffener running lengthwise;

said first stiffener being located between said tracked fastener and said insulation of said skirt of said cap, said insulation extending along said stiffener lengthwise, and laterally away from said stiffener toward said first periphery of said skirt of said cap;

said tracked fastener being longer than said length of said insulated main body and said stiffener being longer than said insulation of said skirt of said cap.

2. The insulated container assembly of claim 1 wherein:

said first margin of said second periphery of said skirt of said cap is longer than said insulated main body of said container assembly;

said first margin of said second periphery of said skirt of said cap extends lengthwise beyond said insulation of said skirt of said cap; and said first margin of said second periphery is folded into a triangular flap at each end of said first portion of said tracked fastener, said triangular flap being lengthwise beyond said insulation of said skirt of said cap.

3. The insulated container assembly of claim 2 wherein said tracked fastener is a waterproof zipper, and when said zipper is closed said insulated container assembly is waterproof.

4. The insulated container assembly of claim 1 wherein at least one of said first margin and said second margin defines a U-shaped jaw.

5. The insulated container assembly of claim 4 wherein both said first margin and said second margin define a respective U-shaped jaw, and said respective U-shaped jaws are symmetrically operable and opposed.

6. The insulated container assembly of claim 1 wherein said body of said container is RF welded.

7. The insulated container of claim 1 wherein:

said first periphery has a join to said main body, said join being RF welded;

said main body is rectangular, having a pair of first and second spaced apart long sides and a pair of first and second spaced apart short sides;

said first periphery bends hingedly at said join to said main body.

8. The insulated container of claim 7 wherein said stiffener defines a jaw bone.

9. The insulated container of claim 8 wherein said first jaw bone is attached to a floating hinge.

* * * * *